United States Patent [19]

Marano

[11] 4,262,894

[45] Apr. 21, 1981

[54] APPARATUS FOR MOVING AN OBJECT, IN PARTICULAR THE TOP SHEET OF A STACK OF INDIVIDUAL SHEETS OF CUT PAPER

[75] Inventor: Herbert W. Marano, Summit, N.J.

[73] Assignee: Vydec, Inc., Florham Park, N.J.

[21] Appl. No.: 941,227

[22] Filed: Sep. 11, 1978

[51] Int. Cl.[3] ..... B65H 3/06

[52] U.S. Cl. ..... 271/4; 74/207; 198/722; 271/114; 271/118; 271/273; 271/314; 400/625

[58] Field of Search ..... 271/118, 117, 3, 4, 271/DIG. 9, 273, 21, 22, 23, 80, 264, 272, 274, 275, 109, 114, 314; 198/722, 723, 624; 226/154, 180, 49-51; 414/123, 129, 90; 400/624, 625; 74/207; 242/201

[56] References Cited

U.S. PATENT DOCUMENTS

| | | | |
|---|---|---|---|
| 2,366,206 | 1/1945 | Metzner | 400/625 |
| 3,576,322 | 4/1971 | Goplen | 271/117 |
| 3,874,290 | 4/1975 | Suzuki | 271/DIG. 9 X |
| 4,036,458 | 7/1977 | Matthey et al. | 74/207 X |

FOREIGN PATENT DOCUMENTS

| | | | |
|---|---|---|---|
| 2715649 | 1/1978 | Fed. Rep. of Germany | 400/625 |

*Primary Examiner*—Bruce H. Stoner, Jr.
*Attorney, Agent, or Firm*—Carella, Bain, Gilfillian & Rhodes

[57] ABSTRACT

Apparatus for moving an object, such as for example the top sheet of a stack of individual sheets of cut paper, including a motor which upon energization of the motor to rotate its drive shaft having a drive member provided thereon, is pivoted toward the object to cause the drive member to engage the object and move the object upon rotation of the drive shaft. Such pivoting of the motor and drive shaft is produced by using force received from the drive shaft to produce another force which in turn produces torque which causes pivoting of the motor and drive shaft toward the object to be moved.

9 Claims, 22 Drawing Figures

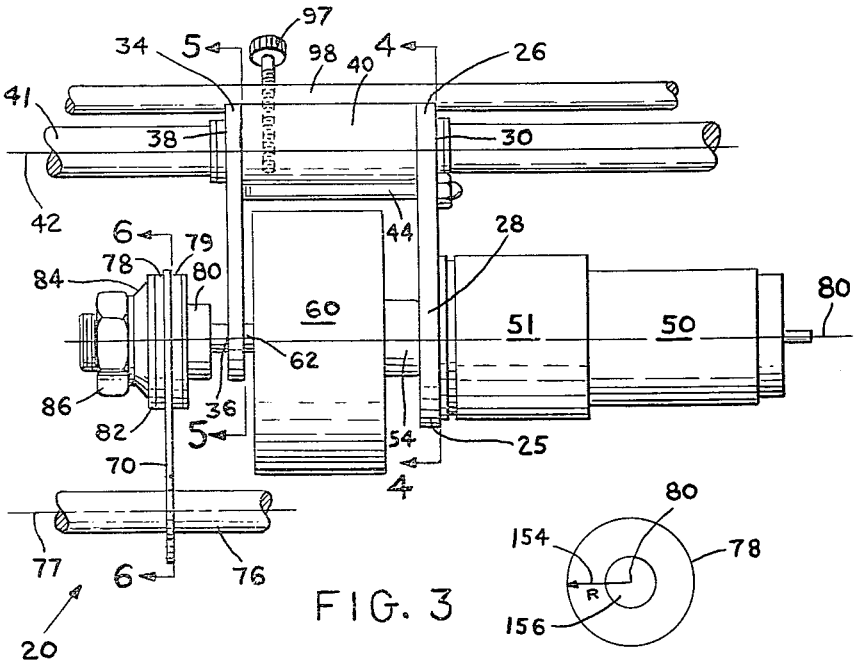
FIG. 3
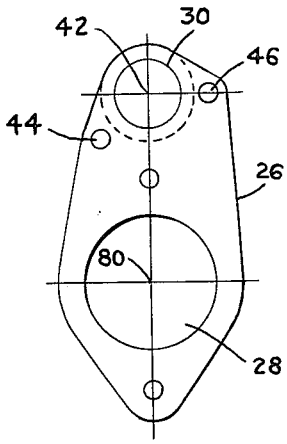
FIG. 4
FIG. 7
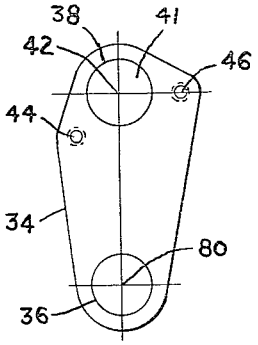
FIG. 5
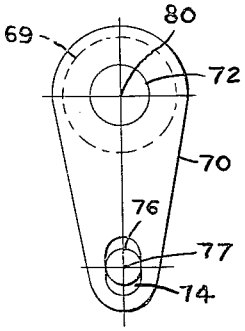
FIG. 6
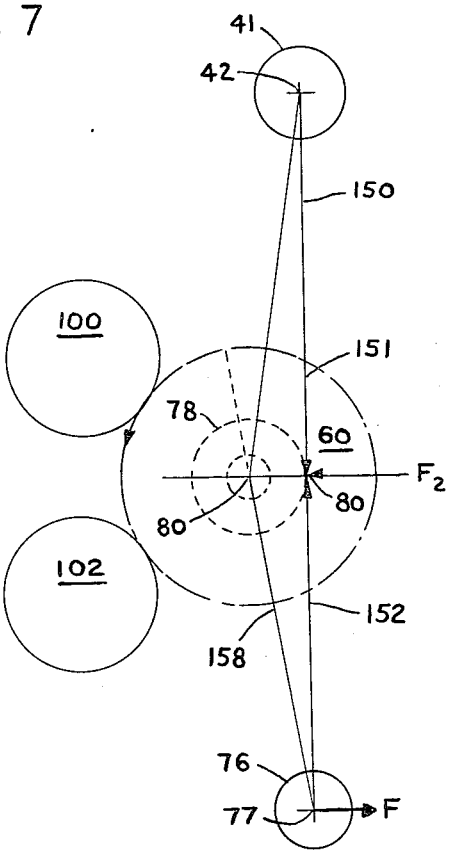
FIG. 9
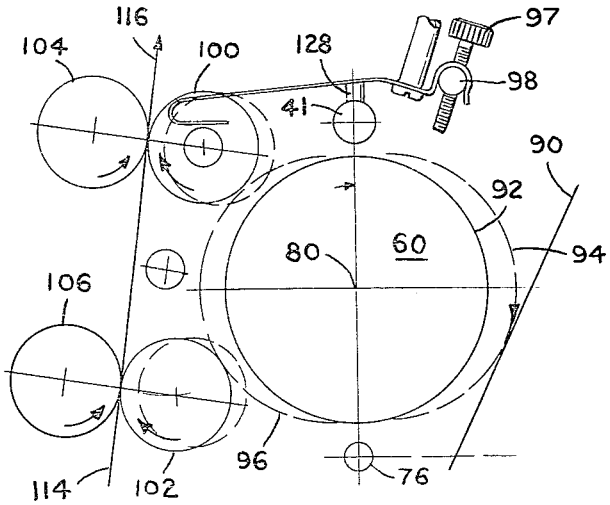
FIG. 8

APPARATUS FOR MOVING AN OBJECT, IN PARTICULAR THE TOP SHEET OF A STACK OF INDIVIDUAL SHEETS OF CUT PAPER

BACKGROUND OF THE INVENTION

1. Field of the Invention

This invention relates generally to apparatus for moving an object, and in particular relates to apparatus generally referred to in the art as sheet feeders for feeding individual sheets of cut paper into, and into and out of, printers, typewriters and other paper handling apparatus such as duplicators, etc.

2. Description of the Prior Art

The prior art is replete with many different apparatus for moving various objects and many types of sheet feeders are also known to the prior art for feeding individual sheets of cut paper as distinguished from continuous rolls of paper.

Generally, such prior art sheet feeders utilize a drive roller in contact with the top sheet of a stack of cut sheets of paper to feed the sheets of paper individually into a printer, typewriter or the like. The contact between the drive roller and the individual sheets of cut paper is usually effected by either urging the stack of paper into contact with the drive roller or by maintaining continuous contact between the drive roller and the stack of paper and by intermittently rotating the drive roller when paper feed is desired. The coefficient of friction of the drive roller, that is the surface texture, is varied to enable movement of different weight paper.

The prior art sheet feeders also typically move the drive roller into contact with the paper through the use of solenoids which move the shaft upon which the drive roller is rotatably mounted. Upon the drive roller contacting the paper, a motor typically connected to the drive roller shaft through a belt is energized to rotate the roller and move the engaged paper.

Movement of paper sheets by such prior art sheet feeders thus necessitates use of a motor, or motors, to rotate the drive rollers, belts to connect the motors to shafts or components to be driven, solenoids to place drive rollers in contact with the paper and all of the necessary bearings, journals, etc. to permit proper functioning of the various parts. The construction and maintenance of such prior art sheet feeders is accordingly costly, their reliability is hampered by the relative movement of so many components, and the trouble free service life of such feeders is limited by the need to replace components subject to wear. Also, the use of solenoids generally requires undesirable excess, electrical power to be provided to the prior art sheet feeders. Most importantly, use of such solenoids produces electromagnetic interference with other electronic circuitry in the vicinity of the solenoids and also with the circuits required to control the sheet feeder itself.

Moreover, the typical prior art sheet feeder is not capable of handling paper and envelopes of varying widths since the bottom corner triangular stops generally used to assure single sheet feeding (or other equivalent means presently known) are not laterally adjustable. Consequently, different paper trays must be installed each time a user wishes to change paper sizes; this is particularly undesirable, inefficient and costly.

Furthermore, many prior art sheet feeders do not incorporate any bail actuator assembly and, therefore, for fully automatic feeding, they must be used in conjunction with printers having such a feature, thus limiting the range of use of such sheet feeders to compatible printers or typewriters. Moreover, existing bail actuating devices even if included in prior art sheet feeders, also utilize solenoids which need to be continuously energized whenever the bail is at any position other than resting against the platen. This is also undesirable, inefficient and costly.

SUMMARY OF THE INVENTION

The present invention provides improved apparatus for moving an object, and in particular provides a new and improved sheet feeder for feeding the top sheet of a stack of cut sheets of paper into a printer, and into and out of a printer. In particular, a motor having a drive roller provided on its drive shaft is mounted pivotally and apparatus, responsive to energization of the motor for rotating the drive shaft, causes the motor and drive shaft to pivot towards an object and to cause the drive member to engage the object and to move the object upon rotation of the drive shaft. More specificially, the apparatus for causing the motor and drive shaft to pivot may include a clutch provided on the drive shaft and a pivotally mounted pivot arm engaged by the clutch; during energization of the motor to rotate the drive shaft, the clutch receives force from the drive shaft and applies force to the pivot arm to produce a torque for pivoting the pivot arm which in turn causes the motor and drive shaft to pivot toward the object to be moved, such as for example the top sheet of a stack of individual sheets of cut paper.

Additionally, the present invention includes an adjustable width adjustment to eliminate the necessity for various sized paper trays, and further includes an automatic bail actuator assembly to permit utilization of the present invention on any printer, typewriter, etc.

Accordingly, it will be understood that the primary object of the present invention is to provide new and improved apparatus for moving an object.

The further object of the present invention is to provide a new and improved sheet feeder for feeding individual sheets of cut paper into a printer, typewriter or the like.

A still further object of the present invention is to provide a more fully automatic self-contained sheet feeder having a wide range of compatible paper sizes and capable of being used on a wide variety of printers, typewriters or the like.

Yet another object of the present invention is to provide a sheet feeder including a bail actuator assembly.

A still further object of the present invention is to provide new and improved apparatus for moving an object, and in particular to provide a new and improved sheet feeder apparatus, which does not utilize any solenoids thereby eliminating the above-noted electromagnetic interference produced by such solenoids.

BRIEF DESCRIPTION OF THE DRAWINGS

FIG. 3 is a front view of the feed-eject mechanism taken along line 3—3 of FIG. 2;

FIG. 4 is a side elevation view taken along line 4—4 of FIG. 3;

FIG. 5 is a side elevation view taken along line 5—5 of FIG. 3;

FIG. 6 is a side elevation view taken along line 6—6 of FIG. 3;

FIG. 7 is a front elevation view of a friction disc;

FIG. 8 is a diagrammatic side elevation view of a portion of the feed-eject mechanism, FIG. 9 is a diagrammatic side elevation view of a portion of the invention showing various forces and moment arms;

DESCRIPTION OF THE PREFERRED EMBODIMENT

Figure 1:
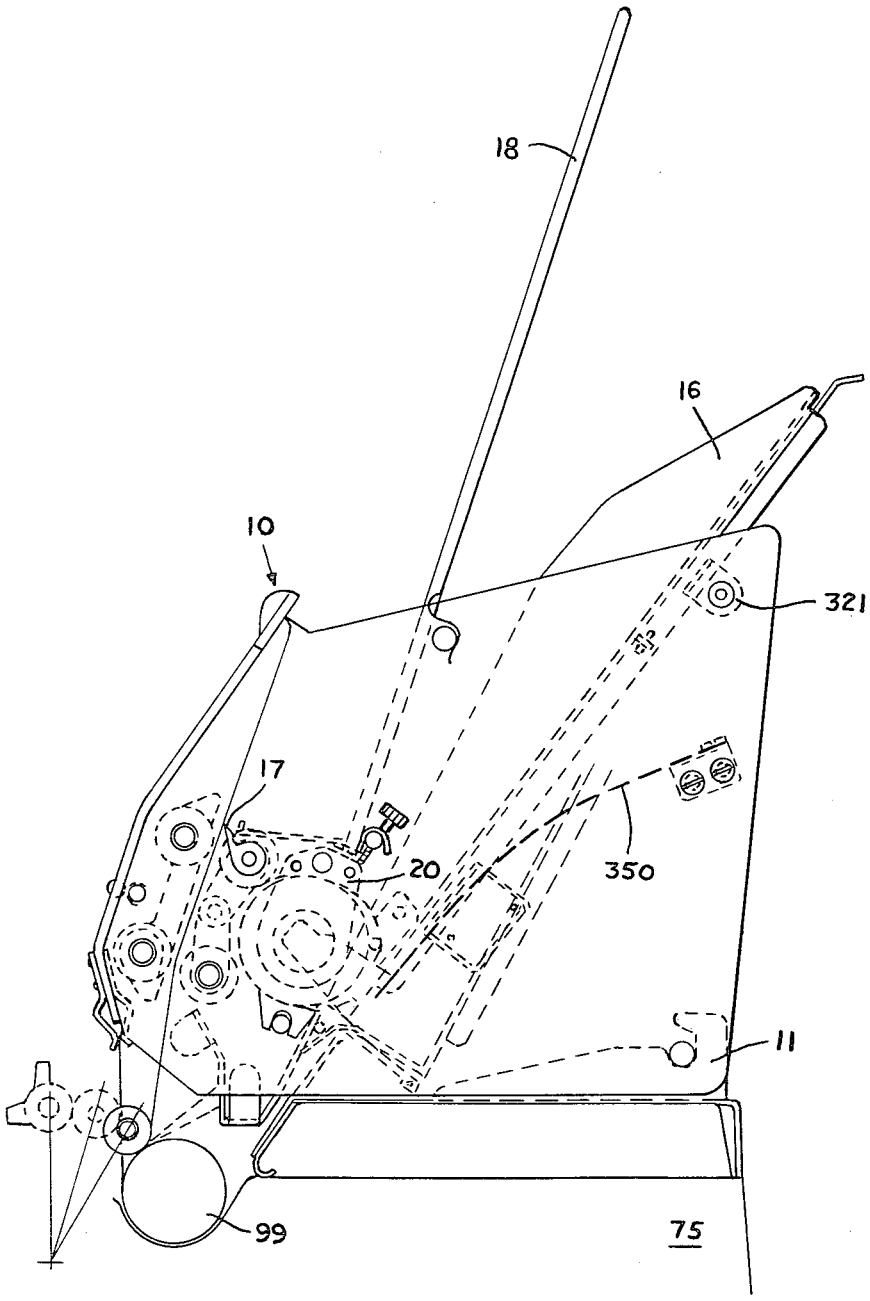
FIG. 1 is a side elevation cross-section view of a sheet feeder embodying the present invention.

Referring now to the drawings, there is shown an apparatus for moving an object as embodied in a sheet feeder for feeding cut sheets of paper. Referring more particularly to FIG. 1, there is shown a sheet feeder generally designated by numeral 10 mounted atop a partially shown printer 75 having a platen 99. Sheet feeder 10 includes several subcomponents not all of which are shown in FIG. 1 but which are shown in the other drawings and described in detail below, and which include feed-eject mechanism 20 (best seen in FIG. 2), bail actuator assembly 200 (best seen in FIG. 11), and a laterally adjustable paper stop 300 (best seen in FIG. 14). It will be understood by those skilled in the art that sheet feeder 10, the embodiment of the present invention, including the bail actuator assembly may be referred to as an automatic sheet feeder in that the sheet feeding embodiment of the present invention must include apparatus for opening the bail of a printer, typewriter or the like. The advantages offered by the sheet feeding embodiment are enhanced when the sheet feeder may be employed without the necessity for intervention by an operator for the feeding of each sheet. Unattended or non-operator involved sheet feeding is enhanced by a bail actuator assembly which makes the sheet feeder an automatic sheet feeder.

The several components and shafts within sheet feeder 10 are mounted between right side panel 12 shown in FIG. 1, and left side panel 14, not shown in FIG. 1 but symmetrically oriented to right side panel 12 on the other side of printer 75. It will be noted that sheet feeder 10 may be detachably mounted atop a printer 75 by hook or hinge means 11. In general operation, sheet feeder 10 feeds individual or cut paper sheets from paper supply tray or hopper 16 via feed-eject mechanism 20, and upon completion of printing operations feed-eject mechanism 20 ejects the paper into paper eject tray 18. The operation and structure of sheet feeder 10 will be best understood by reference to the following drawings pertaining to various subcomponents of sheet feeder 10.

Figure 2:
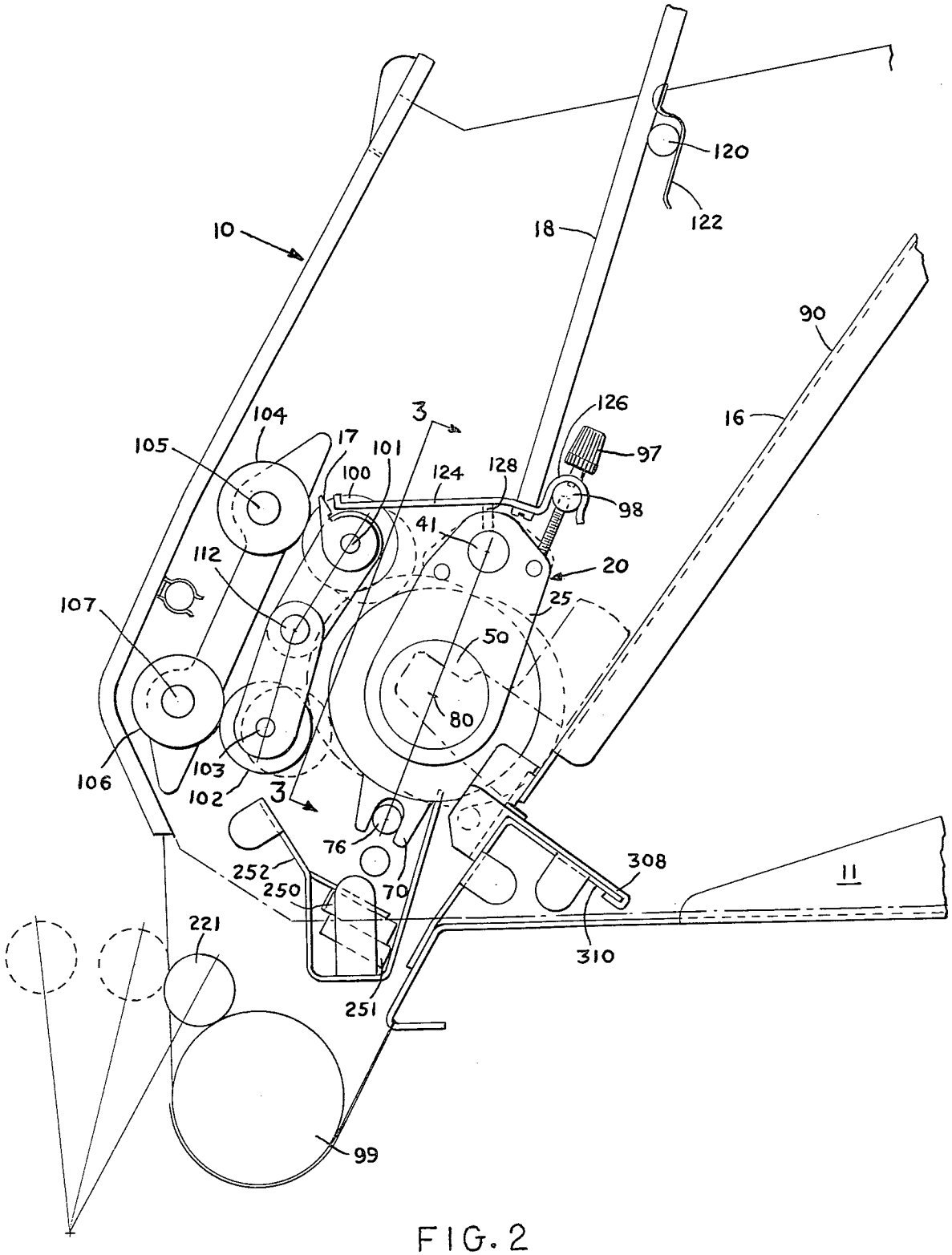
FIG. 2 is an enlarged view of a portion of FIG. 1.

Accordingly, in FIG. 2 there is shown for clarity an enlarged view of a portion of FIG. 1. Specifically, FIG. 2 clarifies the interconnecting structural relationship between feed-eject mechanism 20, paper hopper 16, paper eject tray 18 and several other components of the sheet feeder 10. FIG. 3 shows a front view of the feed-eject mechanism 20 of FIG. 2 taken along line 3—3 (paper eject tray 18 is not shown).

Referring now to FIG. 3, feed-eject mechanism 20 is comprised in part of a frame 25 having a right support 26 and a left support 34, best seen in FIGS. 4 and 5 respectively. Right support 26 has a motor aperture 28 and a motor pivot shaft aperture 30, and left support 34 has a drive shaft aperture 36 and a motor pivot aperture 38. The pivot apertures 30 and 38 are mounted on pivot shaft 41 and aligned on axis 42, and the motor aperture 28 and drive shaft aperture 36 are aligned on axis 80. The right and left supports 26 and 34 of frame 25 are interconnected by a cylindrical sleeve or bushing 40 secured between the respective motor pivot apertures 30 and 38 concentrically about axis 42 by connecting bolts 44 and 46 and associated nuts (bolt 46 not shown in FIG. 3).

Drive motor 50 has a gear reduction assembly 51 secured to it and the combination, 50 and 51, is secured to motor aperture 28. Motor 50 has an output shaft 54 aligned with axis 80 to which is concentrically secured a textured drive roller 60 also aligned with axis 80. Drive roller 60 has, in turn, a drive roller shaft 62 axially secured thereto and in engagement with drive shaft aperture 36 of left support 34.

It will be noted by those skilled in the art that frame 25, as described herein, is fairly rigid and pivotable or rotatable about pivot shaft 41 and axis 42 while drive roller 60 is rotatable about axis 80.

The structure of feed-eject mechanism 20 as shown in FIG. 3 also incorporates pivot arm 70, best seen in FIG. 6. Pivot arm 70 has a drive shaft aperture 72 (FIG. 6) for mating about axis 80 and a reaction pivot shaft aperture 74 (FIG. 6) for mating one end of pivot arm 70 with reaction pivot shaft 76 having an axis 77 which is parallel to motor pivot shaft 41 and axis 80. Annular friction discs 78 and 79 concentric with axis 80 are placed on each side of pivot arm 70 and are adjustably compressed by washer 82, annular spring 84 and adjustment nut 86 against a flanged nut 80 which is secured to drive roller shaft 62. Friction forces generated by the contact between discs 78 and 79 and the facing surfaces of pivot arm 70 are variable by adjustment of nut 86 and the resulting variable compression of spring 84.

The construction of discs 78 and 79 is best understood by reference to FIG. 7 showing a plan view of one disc 78 having an aperture 156 for mating with drive roller shaft 62 and a radius 154. The surface of discs 78 and 79 is contiguous to both sides of pivot arm 70 along the area 69 shown in FIG. 6. Discs 78 and 79 thus constitute a friction clutch and although it will be recognized by those skilled in the art that various materials could be utilized to make the discs, the preferred embodiment utilizes discs made essentially from cork.

An understanding of feed-eject mechanism 20 is aided by reference to FIG. 3 and FIG. 8 showing a schematic right end view of drive roller 60 relative to the top sheet of paper 90 in paper hopper 16 (not shown). Upon activation of motor 50 to cause drive roller 60 to rotate clockwise as viewed in FIG. 8, it will be recognized by those skilled in the art that frictional forces generated by the contact of rotating discs 78 and 79 with pivot arm 70 produce a torque tending to rotate arm 70 about axis 80. Since pivot arm 70 is constrained by pivot shaft 76, it is unable to rotate about axis 80 in response to these frictional forces. Consequently, rotation of discs 78 and 79 about axis 80 causes pivot arm 70 to react against pivot shaft 76 thereby causing frame 25 and drive roller 60 to pivot about pivot shaft 41. Thus, clockwise activation of motor 50 (as viewed in FIGS. 2 and 8) will urge drive roller 60 from neutral or normal position 92 into feed position 94 and into contact with the top sheet 90 of a stack of paper. Counterclockwise activation of motor 50 will urge drive roller 60 into eject position 96 which will be described below.

It will be recognized by those skilled in the art that the apertures of pivot arm 70 must have sufficient play or looseness when mated with corresponding shafts to permit pivot arm 70 to deviate from neutral or normal sufficiently to allow drive roller 60 to contact the paper (to be fed) or the auxiliary rollers described below. It will be noted by those skilled in the art that pivoting of drive roller 60 about axis 42 (pivot shaft 41) will continue such that an ever increasing force will be exerted by the drive roller 60 against paper sheet 90. Depending upon the surface texture of the drive roller, an excessive force may cause a plurality of paper sheets to be fed simultaneously. Accordingly, a stop screw 97 mounted on shaft 98, seen in FIGS. 2, 3 and 8, is provided to engage bolt 46 connecting left and right supports 34 and 26. Stop screw 97 serves as a counterclockwise stop or limit preventing drive roller 60 from being urged beyond feed position 94. A clockwise stop means will be described below.

An understanding of the operation of the invention as embodied in feed-eject mechanism 20 is further aided by reference to FIG. 9 showing a diagrammatic sketch of one clutch friction disc 78, reaction pivot shaft 76, motor pivot shaft 41 and the various forces and moment arms occurring in the eject mode of operation of this invention for ejection of a paper sheet by rotation of auxiliary rollers 100 and 102 to be described below.

It is noted that shafts 76 and 41 are aligned along a straight line 150 passing through axis 80 when the drive roller is in its normal position. Straight line 150 has a segment 151, extending from normal axis 80 (lying on line 150) to axis 42, and a segment 152 extending from normal axis 80 to axis 77.

As motor 50 (not shown) is activated counterclockwise as viewed in FIG. 9, disc 78 rotates counterclockwise while producing some counterclockwise torque about axis 80 due to frictional forces. The disc torque may be understood by reference to FIG. 7 showing a plan view of an annular disc 78 centered on axis 80 and having a radius 154 and an aperture 156 for mating with drive roller shaft 62 (not shown).

The torque T generated by a rotating disc may be simply expressed as the product of the frictional force f exerted tangentially at radius R. For simplicity, it is convenient to ignore any integration of torque moment over the surface area of the disc, and it is equally convenient to assume only one disc is utilized. Thus, $T=fR$ and f may be determined from the equation $f=\mu P$ where P is the pressure exerted by brake spring 84 against the discs and $\mu$ is the coefficient of friction of the disc. In one embodiment, cork friction discs having $\mu=0.8$ are utilized, P is set to be 15 ounces, $R=0.437$ inches. Thus, $F=\mu P=12$ ounces and $T=fR=5.2440$ inch-ounces. Those skilled in the art will understand that this force f may be expressed as exerting force F against reaction pivot shaft 76 through clutch link 158. Clutch link 158 is essentially pivot arm 70. It is further noted that link 158 and line segment 152 are the same dimension, i.e. the distance between axis 77 and axis 80, although their respective magnitudes vary due to the pivoting motion of axis 80. Nevertheless, force f exerted at radius R will cause a force F to occur on reaction pivot axis 77 as shown in FIG. 9. It will be further understood that the direction of F is not necessarily always normal to line 150 as shown; it may vary slightly but it is conveniently assumed to be normal in this discussion.

If the clutch disc is considered a rigid member capable of exerting a limited force F against the reaction pivot shaft 76, it is then possible to determine the magnitude of force $F_2$ with which the disc is urged to the left, $F_2$ being the same force urging drive roller 60 to the left since drive roller and disc are both on axis 80. Considering force moments about the motor pivot shaft 41, the clockwise moments equal $F_2$ (1.250 inches) where 1.250 is the length of line segment 151 in the preferred embodiment, and the counterclockwise moments equal F (1.250+1.094) wherein 1.250 and 1.094 are the lengths of line segments 151 and 152 respectively. It is noted that $F_2$ will be greater than F and that there is a certain mechanical advantage, regardless of the fact that certain mathematical simplifications were made in the calculations (e.g. no integration.)

It will be understood by those skilled in the art that clutch link 158 varies in length as disc 78 and drive roller 60 move between feed position, through normal and to an eject position. However, while this motion may affect the magnitude of F at the reaction pivot, $F_2$ is not of practical significance except at the extreme positions (feed and eject) because it is only at those positions that the drive roller is used to move paper (or auxiliary rollers).

An additional aid to the understanding of the operation of the invention as embodied in feed-eject mechanism 20 is as follows. Energization of motor 50 causes disc 78 to rotate relative to pivot arm 70. However, prior to such relative rotation, disc 78 is in static frictional engagement with pivot arm 70 rather than dynamic frictional engagement. As will be understood by those skilled in the art, the forces inherent in said static frictional engagement are variable and dependent upon the pressure exerted by spring 84. This pressure generates a force between disc 78 and pivot arm 70, which force is directed parallel to axis 80 and exists at all points of contact between disc 78 and pivot arm 70. As will be understood by those skilled in the art, there is a relationship between this force parallel to axis 80 and the frictional forces acting in the plane of contact between disc 78 and pivot arm 70. During static frictional engagement there is a force of static friction that exists in said plane by virtue of the contact between the disc and the pivot arm.

At a point in time immediately prior to energization of motor 50, the aforementioned force of static friction prevents any relative rotation between disc 78 (and therefore the corresponding drive shaft) and pivot arm 70. Upon energization of motor 50 the rotational forces associated with the drive shaft will be translated into forces in the plane of contact between disc 78 and pivot arm 70. As is well known to those skilled in the art, these forces will constitute an infinite number of force couples about axis 80. Since relative rotation between pivot arm 70 and the drive shaft is prevented by virtue of the pressure exerted by spring 84, and since pivot arm 70 is constrained to pivot only about the reaction shaft 76, said force couples will produce a net torque about reaction shaft 76 whereupon pivot arm 70 will be pivoted therearound. The direction of such pivoting is naturally dependent upon the direction of rotation of motor 50. The pivoting action of pivot arm 70 about reaction shaft 76 necessarily causes the pivoting of drive roller 60 about pivot shaft 41.

The rotation of drive roller 60 about its axis 80 will begin at the point in time when further pivoting of said drive roller is prevented by the clockwise and counterclockwise stops, as the case may be. It is at that point in time that the clutch comprising the friction discs will "slip" and permit rotation of drive roller 60 relative to pivot arm 70.

In summary, said clutch receives force from said drive shaft and applies force to pivot arm 70 to produce torque for causing said pivot arm to pivot and to in turn cause said motor and said drive shaft to pivot toward an object to be moved, which in the preferred embodiment is a sheet of paper. This pivoting action causes the drive roller to engage said object and the clutch thereupon allows rotation of the drive roller relative to the pivot arm whereby the object may be moved. It will be noted that at all times during energization of motor 50 said clutch is continuously applying force to pivot arm 70 and thereby continuously producing torque for causing said pivot arm to pivot around said reaction shaft.

Returning now to FIG. 2, motor 50 may be activated by some control means (not shown) for a sufficient period of time to permit drive roller 60 to engage paper sheet 90 and to urge that sheet to a desired position. For example, in the preferred embodiment, drive roller 60 should urge a paper sheet for a sufficient distance whereupon the paper sheet will be subsequently engaged and further transported by platen 99. Furthermore, the distance required is conveniently predetermined to enable the sheet feeder to also feed any individual pieces of material such as individual paper sheets of various sizes or individual envelopes or any other relatively narrow item (e.g. index cards, etc.). The requisite time period may be sensed by conventional means and upon expiration of such period, deactivation of motor 50 will cease rotation of drive roller 60.

Subsequent activation of motor 50 for a short period in a direction opposite that causing rotation of drive roller 60 will urge the roller away from the paper and back into normal position 92. Drive roller 60 will be maintained in position 92 without motor activation due to inherent friction or tension in motor 50 and the associated gear reduction assembly 51.

Figure 10:
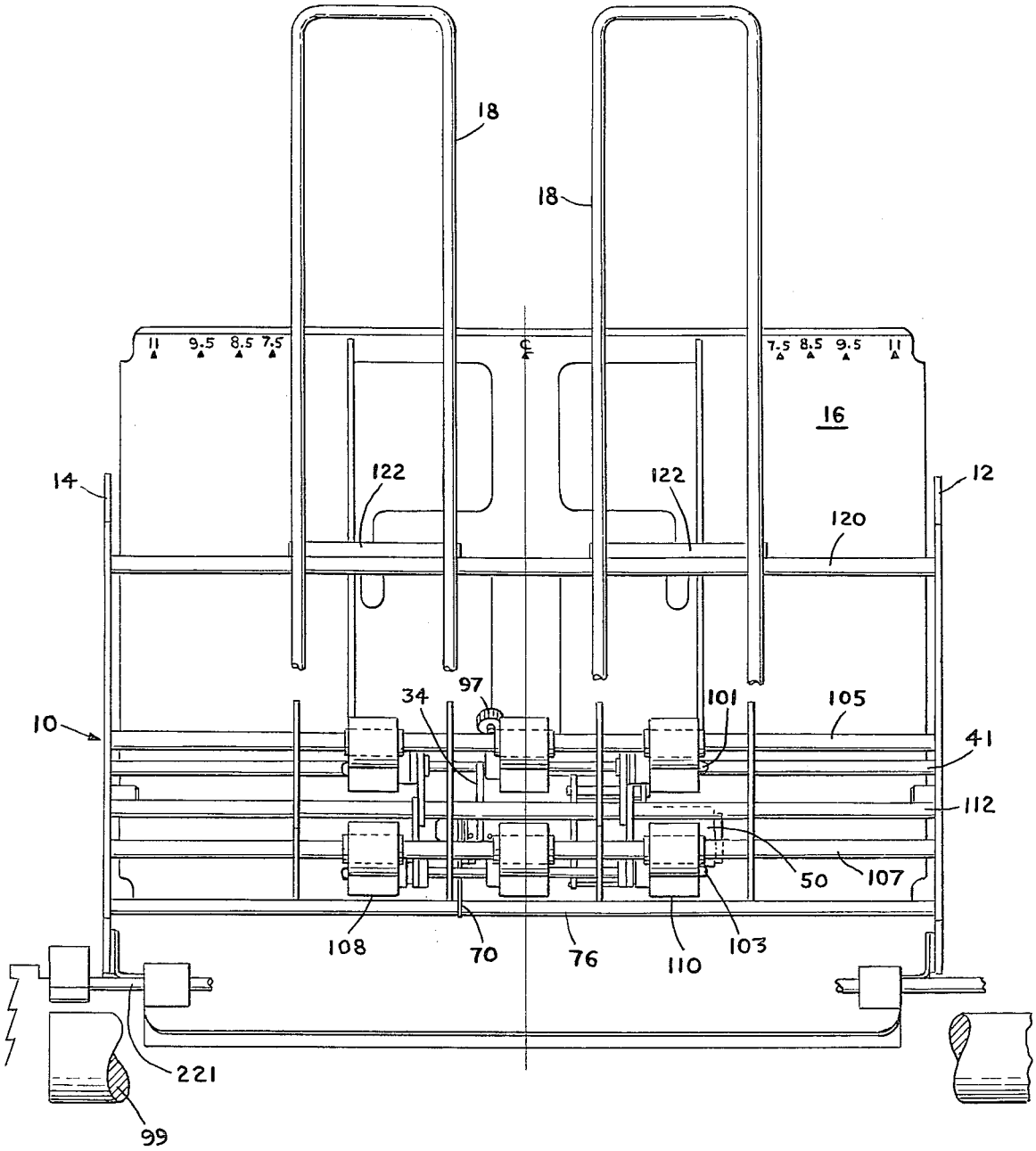
FIG. 10 is a cut-away front elevation view of the improved sheet feeder shown in FIG. 1.

As stated above, counterclockwise activation of motor 50 will urge drive roller 60 into eject position 96. The ejection of paper is accomplished by the cooperation of drive roller 60 and auxiliary movable rollers 100 and 102 and respectively opposed auxiliary fixed rollers 104 and 106 as best seen in FIG. 2 where the auxiliary rollers are shown in an eject (contiguous or touching) configuration. Each auxiliary roller, 100, 102, 104 and 106, is mounted on its own shaft, 101, 103, 105 and 107 respectively, each of which is parallel to axis 80. Furthermore, the opposed auxiliary rollers and drive roller are aligned so that counterclockwise rotation of drive roller 60, while in its eject position 96, will cause clockwise rotation of auxiliary movable rollers 100 and 102 and counterclockwise rotation of auxiliary fixed rollers 104 and 106. All opposed auxiliary rollers are used in triplicate sets (as best seen in FIG. 10) although only one set of auxiliary rollers (the middle set shown in FIG. 10) is actively driven by drive roller 60. While triplicate use is preferred in order to provide a more even distribution of forces on paper sheets during feeding and ejection, the description of the operation and numbering of auxiliary rollers is restricted to the middle set. The side sets of auxiliary rollers, 108 and 110, are slaved to the motion of the driven middle set since all respective auxiliary rollers are mounted on shafts 101, 103, 105 and 107.

When drive roller 60 is in normal position 92 auxiliary movable rollers 100 and 102 are not in contact therewith. Upon counterclockwise activation of motor 50, drive roller 60 is caused to pivot clockwise about shaft 41 whereupon the drive roller will come in contact with auxiliary movable rollers 100 and 102 and cause them to pivot about roller pivot shaft 112 until they are stopped by fixed rollers 104 and 106 which act as clockwise stops (analogous to stop screw 97). As shown in FIG. 8 a paper sheet 114 may be interposed between the opposed auxiliary rollers, whereby, upon continued counterclockwise rotation of drive roller 60 about axis 80, paper sheet 114 will be ejected in direction 116 by the cooperative rotation of the auxiliary rollers in the direction of the arrows.

Referring now to FIG. 2, motor 50 may be activated in a counterclockwise direction for a period of time sufficient to cause a paper sheet to be withdrawn from platen 99 and ejected into paper eject tray 18. Opposite activation of motor 50 may then cause it and drive roller 60 to return to a normal position, ready for the next cycle.

Referring now to FIG. 10, there is shown a front elevation cut-away view of the improved sheet feeder 10. It is apparent from FIG. 10 that several of the aforementioned shafts are parallel and extend between the right and left side panels, 12 and 14, of the sheet feeder: i.e. auxiliary roller shafts 105 and 107, frame pivot shaft 41, auxiliary pivot shaft 112, pivot arm 70, reaction shaft 76 and stop screw shaft 98 (not shown). The auxiliary movable roller shafts 101 and 103 are movable relative to side panels 12 and 14 and, accordingly, do not extend between the side panels.

Figure 18A:
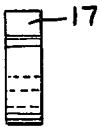
FIGS. 18*a* and 18*b* are a top plan view and a side elevation view respectively of a deflector.
Figure 18B:
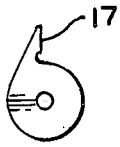

It is also clear from a consideration of FIG. 10 in conjunction with FIG. 2 that paper eject tray 18, shown in part in FIG. 10, is supported in sheet feeder 10 by shaft 120 and shaft 98. It is noted that clips 122 secure tray 18 to shaft 120. Ledge 124, secured to the bottom of said rods to form tray 18, has a hook portion 126 for detachably engaging shaft 98 and a stub 128 for resting on shaft 41. It will be understood that hook 126 and stub 128 may be placed on their respective shafts at points so as not to interfere with the operation of feed-eject mechanism 20. Also, ledge 124 may have notches (not shown) to enable its placement adjacent rollers 100, as shown in FIG. 2, without interfering with the operation thereof. Furthermore, a deflector or sheet lifter 17, best seen in FIGS. 18*a* and 18*b*, is rotatably mounted on shaft 101 and is retained by a spring (not shown) to prevent ejected paper from settling back and between auxiliary rollers 100 and 104 after having been ejected. Thus, a newly ejected paper sheet will be urged on top of the immediately preceding ejected sheet rather than possibly under it.

Figure 11:
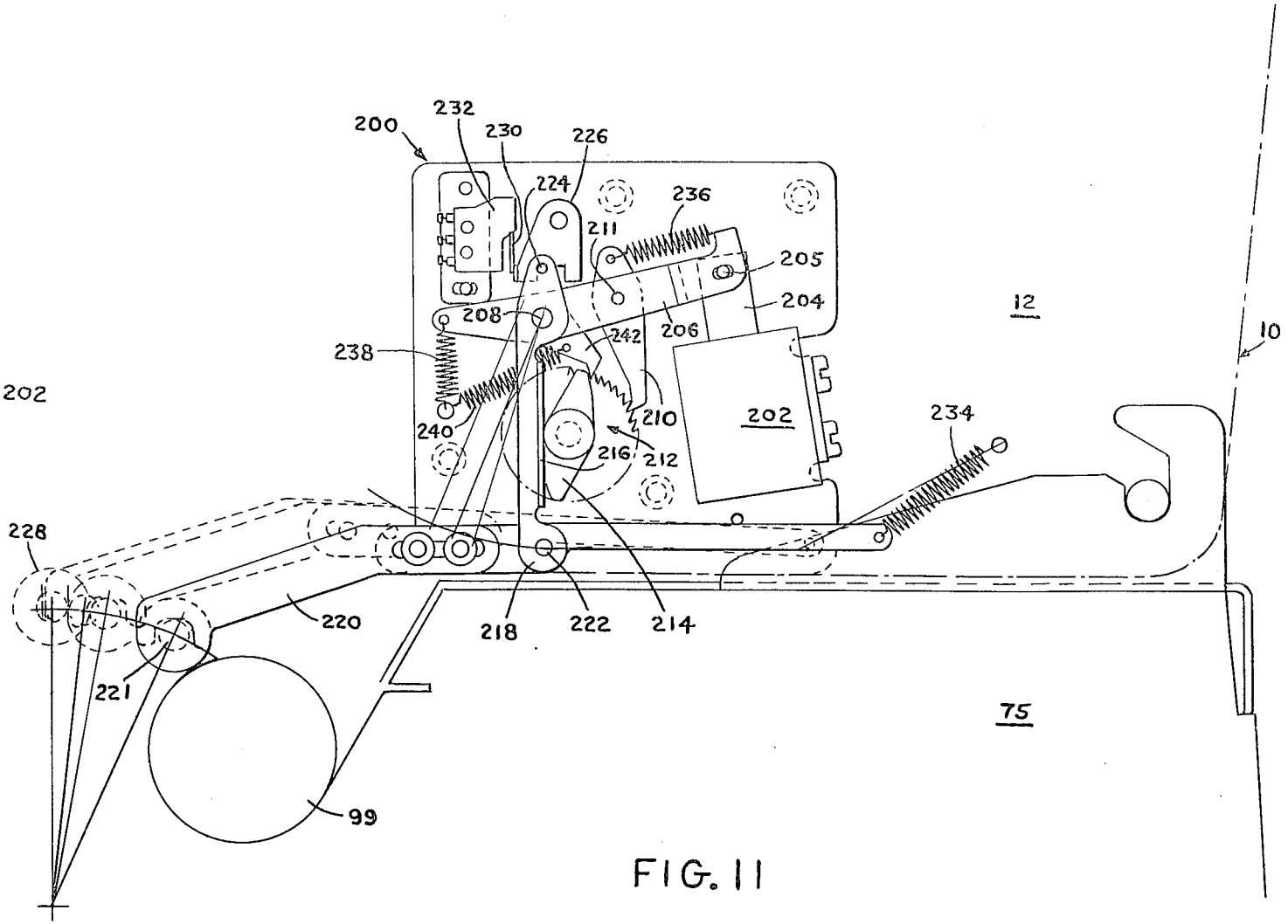
FIG. 11 is a side elevation cross-section of the bail actuator assembly of the improved sheet feeder.
Figure 12:
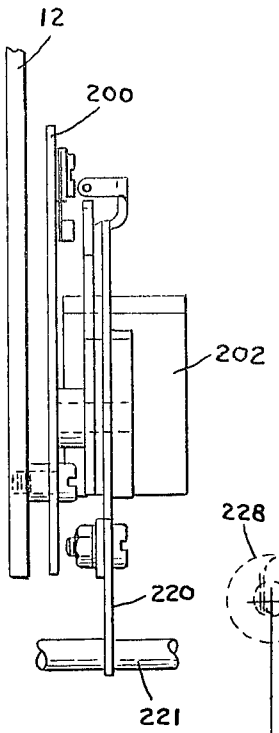
FIG. 12 is a left side view of FIG. 11.

Referring now to FIGS. 11 and 12, there is depicted a bail actuator assembly generally designated 200 and its relationship to sheet feeder 10 shown in phantom lines.

Actuator 200 is activated by solenoid 202, the plunger 204 of which is rotatably secured at point 205 to one end of lever arm 206 which is pivotable about pivot axis 208. Between point 205 and axis 208 a pawl 210 is rotatably affixed to lever arm 206 at point 211.

Upon increment energization of solenoid 202, pawl 210 will rotate ratchet wheel 212 clockwise. An involute profile cam 214 affixed to wheel 212 is always contiguous to point 216 of 218 which is pivoted about axis 208 as is lever arm 206. Link 218 is at one end rotatably secured to bail arm 220 at point 222 and its other end has affixed thereto a pin 224.

As solenoid 202 is incrementally energized, link 218 is pivoted about axis 208 and bail arm 220 moves to the left to open bail 221 as shown in FIG. 11. Simultaneously, pin 224 is urged to the right and engages a rotatable tab 226. When bail arm 220 reaches a predetermined position for example 228, pin 224 causes tab 226 to release lever arm 230 of snap switch 232 thereby cutting off the train of pulses to solenoid 202.

Upon completion of the paper feeding phase described above, a pulse train is again applied to solenoid 202 to cause cam 214 to incrementally rotate to move bail arm 220 to the right to close whereupon pin 224 will again rest against lever arm 230 cutting off the pulse train.

Link 218 is held in contact against cam 214 by bail return spring 234, pawl 210 is held against ratchet wheel 212 by spring 236 and lever arm 206 is returned to a rest position between pulses by spring 238. Spring 240 holds pawl 242 in contact with ratchet wheel 212 to prevent its counterclockwise rotation in the intervals between energizing pulses.

Considering now the entire operating cycle of the embodiment above described, it is possible to trace the path of a paper sheet through the sheet feeder 10 by referring to FIG. 2. The top sheet 90 of a stack of paper placed in a spring-loaded paper hopper 16 (spring not shown), is transported upon clockwise activation of motor 50 by command signal until top sheet 90 is engaged by platen 99. The motion of paper past edge-of-paper sensors 250 and 251 triggers these sensors which serve to monitor the necessity for activating the bail or for feeding another sheet. Upon feeding of paper, bail 221 may be opened by appropriate command signals from a source not shown and then closed and platen 99 rotated a predetermined distance to position the paper as desired, e.g. for printing to begin below a letterhead. As printing continues and platen 99 is advanced, the paper will be deflected toward the auxiliary rollers by deflection plate 252. The paper may be advanced by platen 99 until printing is completed and until the paper is between both top and bottom sets of opposed auxiliary rollers. Then, upon counterclockwise activation of motor 50, auxiliary movable rollers 100 and 102 are pivoted about roller pivot shaft 112 to grip the paper against auxiliary fixed rollers 104 and 106. Continued rotation of drive roller 60 and, consequently, auxiliary movable rollers 100 and 102, will cause paper to move in direction 116 (FIG. 8) and be ejected from the printer and deposited in paper eject rack 18. Clockwise activation of motor 50 will repeat the cycle if desired.

Figure 13:
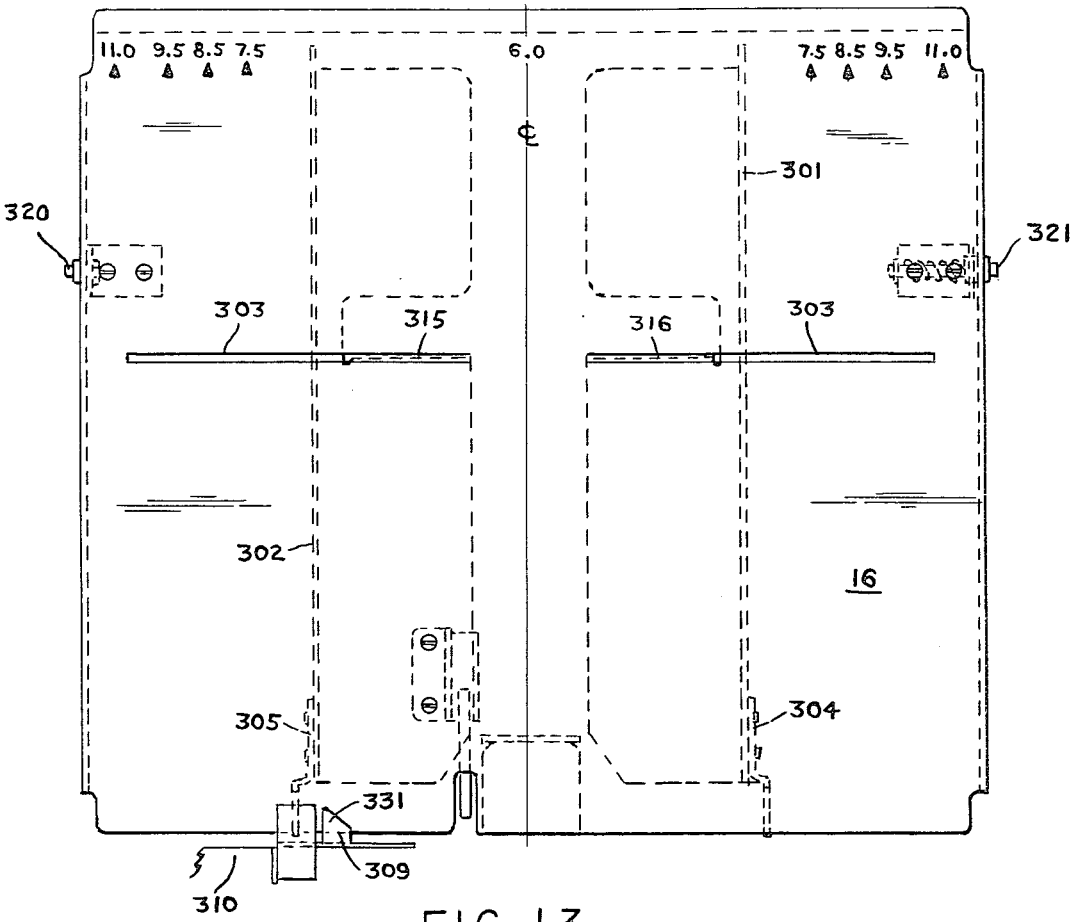
FIG. 13 is a plan view of a paper hopper and a laterally adjustable paper stop assembly.
Figure 14:
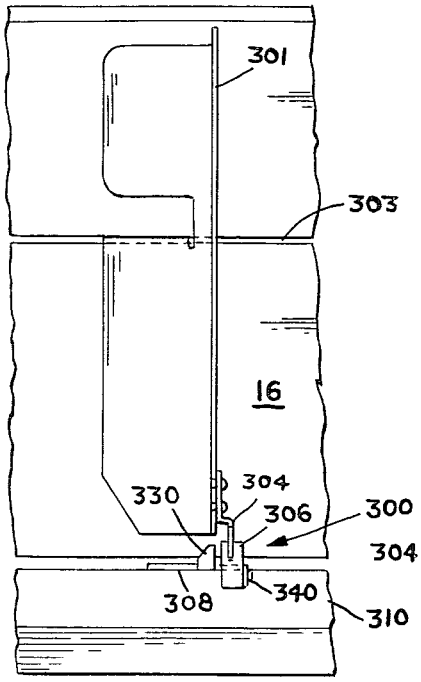
FIG. 14 is a enlarged view of a portion of FIG. 13.

An additional component of this invention is shown in FIG. 13, wherein there is depicted a plan view of paper hopper 16, and FIG. 14 wherein there is depicted an exploded view of a portion of FIG. 11 having a laterally adjustable paper stop generally designated 300.

Paper hopper 16 has two slots 303 and is pivotable about spring loaded pivot pins 320 and 321 which engage suitable bores (not shown) in left and right side panels, 12 and 14, of sheet feeder 10. Hopper 16 is urged to so pivot by a spring 350 (FIG. 1) which continuously urges the hopper and its contents toward triangular stops 308 and 309 to be described below.

Forming part of adjustable paper stop 300 are right paper guide 301 and left paper guide 302 which rest on tray 16. The guides, 301 and 302, are symmetrical and slidably engaged with slots 303 and cross member 310. While slidable engagement with slot 303 is effected by stamped out projections 315 and 316, slidable engagement with cross member 310 is effected by left triangular stop 309 and right triangular stop 308 adjustably secured to left and right guides 302 and 301 respectively. Interposed between paper guides 301 and 302 and triangular stops 308 and 309 are projections 304 and 305 respectively.

Figure 15:
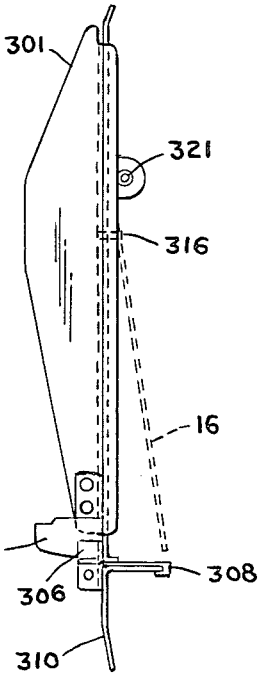
FIG. 15 is a right side view of FIG. 14.

The function of projections 304 and 305 is best seen by reference to FIG. 15 showing a right end view of FIG. 13. For simplicity, only right guide 301 and elements associated therewith are shown (the left side components are symmetrical). As shown in FIG. 15, paper hopper 16 will, if full of paper, appear in the position shown in phantom lines. Nevertheless, the construction of projection 304 permits it, and therefore right guide 301, to be engaged with right triangular stop 308 at all times, whether hopper 16 is empty or full.

Thus, as paper is used and the amount thereof in hopper 16 decreases, spring means (not shown) will urge hopper 16 and projection 304 clockwise about pivot pin 321 (as seen in FIG. 15) while maintaining engagement between projection 304 and triangular stop 308. Since said triangular stop is slidable along cross member 310 it is apparent that paper in hopper 16 (and adjacent left and right guides 302 and 301) may always be urged against triangular projection 330 of right triangular stop 308 and a corresponding projection 331 on left triangular stop 309.

Figure 16A:
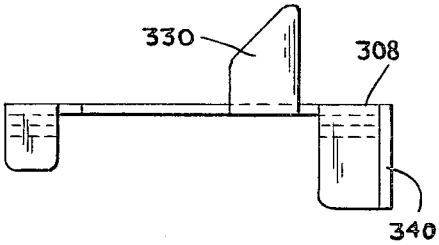
FIGS. 16*a*, 16*b* and 16*c* are a top plan view, a back elevation view and a side elevation view respectively of a right triangular stop.
Figure 16B:
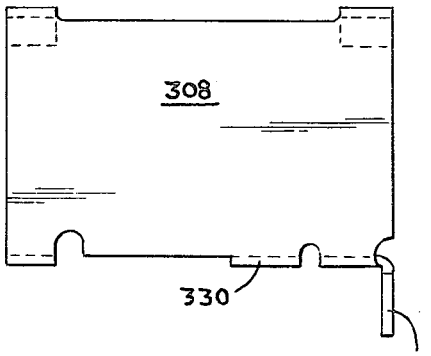
Figure 16C:
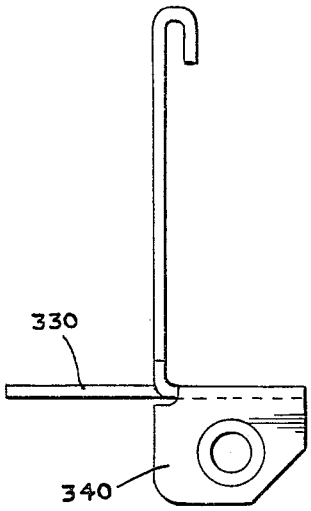
Figure 17A:
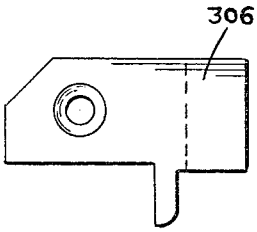
FIGS. 17*a* and 17*b* are a side elevation and a top plan view respectively of one slotted retainer.
Figure 17B:
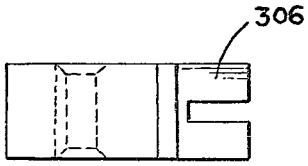

Right triangular stop 308 is best seen in FIGS. 16*a*, 16*b* and 16*c*. The orthogonal relationship between projection 330 and projection 340 permits a slotted retainer 306, best seen in FIGS. 17*a* and 17*b*, to be affixed to projection 340 as shown in FIGS. 14 and 15.

The ability of triangular projections similar to 330 to assure that only one sheet of paper will be advanced by a drive roller is a concept well-known to those of ordinary skill in the art. The novelty herein is in the construction of the various elements permitting lateral adjustment of these triangular projections without the necessity of changing paper trays or hoppers. Left and right paper guides 302 and 301 and triangular stops 308 and 309 are maintained in any desired position by frictional forces between those components and hopper 16 and cross member 310. This facilitates lateral adjustment for varying paper widths.

It is to be understood that many other modifications and improvements of the preferred embodiment might be made without departing from the scope of the teachings of this invention.

What is claimed is:

1. Apparatus for moving an object, comprising:

a fixed pivot shaft;

a fixed reaction shaft displaced in a predetermined direction and at a predetermined distance from said pivot shaft;

a motor having a drive shaft;

a drive member provided on said drive shaft for rotation therewith;

means for supporting said motor and said drive shaft for pivotable movement around said fixed pivot shaft towards said object;

a pivot arm having two ends, one end of said pivot arm mounted on said reaction shaft to permit said pivot arm to pivot therearound towards said object, and the other end of said pivot arm having an aperture formed therein and said drive shaft extending through said aperture sufficiently loosely to permit said drive shaft to rotate with respect to said pivot arm;

a clutch mounted on said drive shaft and being in engagement with the other end of said pivot arm with predetermined force, said clutch during energization of said motor to rotate said drive shaft in a predetermined direction of rotation for continuously receiving force from said drive shaft and said received force initially being less than the force of static friction between said clutch and said other end of said pivot arm and said received force subsequently being greater than said force of static friction whereupon said clutch allows said drive shaft to rotate with respect to said pivot arm with said clutch being in dynamic frictional engagement with said other end of said pivot arm, during the times said clutch is in static frictional and dynamic frictional engagement with said other end of said pivot arm, said clutch for continuously applying force to said other end of said pivot arm to continuously produce torque for causing said pivot arm to pivot around said reaction shaft and toward said object;

upon said pivot arm pivoting towards said object, said other end of said pivot arm continuously applying force to said drive shaft to continuously produce torque for causing said drive shaft and said motor to pivot around said pivot shaft toward said object;

means for stopping said pivoting movement of said motor and said drive shaft towards said object at a predetermined position at which said drive member engages said object; and upon said drive member engaging said object and upon said drive shaft rotating with respect to said pivot arm, said drive shaft rotating said drive member to cause said drive member to move said engaged object.

2. Apparatus for feeding the top piece of material of a stack of individual pieces of material from a hopper into utilization position, said hopper for presenting said top piece of material at a first predetermined position, comprising:

a fixed pivot shaft for being positioned at a second predetermined position with respect to said hopper;

a fixed reaction shaft displaced from and positioned at a third predetermined position with respect to said pivot shaft;

a motor having a drive shaft;

a drive roller provided on said drive shaft for rotation therewith, said drive roller having an outer peripheral portion;

means for supporting said motor and said drive roller for pivotable movement around said fixed pivot shaft towards said stack of material;

a pivot arm having two ends, one end of said pivot arm mounted on said reaction shaft to permit said pivot arm to pivot therearound towards said material, and the other end of said pivot arm having an aperture formed therein and said drive shaft extending through said aperture sufficiently loosely to permit said drive shaft to rotate with respect to said pivot arm;

a clutch mounted on said drive shaft and in engagement with the other end of said pivot arm, and said clutch during energization of said motor to rotate said drive shaft in a predetermined direction of rotation (i) for continuously receiving force from said drive shaft, and (ii) for continuously applying force to said other end of said pivot arm to continuously produce torque for causing said pivot arm to pivot around said reaction shaft and toward said stack of material;

upon said pivot arm pivoting towards said stack of material, said other end of said pivot arm continuously applying force to said drive shaft to continuously produce torque for causing said drive shaft and said motor to pivot around said pivot shaft toward said stack of material;

stop means for stopping said pivoting movement of said motor and said drive shaft towards said stack of material at a fourth predetermined position at which said outer peripheral portion of said drive roller engages said top piece of material; and upon said stopping of said pivoting movement of said drive shaft and said motor at said fourth predetermined position and upon the engagement of said outer peripheral portion of said drive roller with said top piece of material, said clutch for allowing said drive shaft to rotate with respect to said pivot arm to cause said drive roller to rotate and frictionally move said top piece of material from said hopper and to said utilization position.

3. Sheet feeder apparatus for feeding the top sheet of a stack of individual sheets of cut paper from a hopper into engagement with a platen of a printer, said hopper for presenting the top sheet of cut paper at a first predetermined position adjacent said sheet feeder, comprising:

an eject tray for being positioned adjacent said platen and for receiving paper from said platen after printing;

at least one pair of opposed auxiliary rollers for being positioned intermediate said platen and said eject tray and upon rotation thereof and upon a sheet of paper being interposed therebetween by said platen said rollers for ejecting paper into said eject tray;

said sheet feeder also for imparting rotation to said auxiliary rollers;

said sheet feeder further comprising:

a fixed pivot shaft for being positioned at a second predetermined position with respect to said hopper and said printer;

a fixed reaction shaft displaced from and positioned at a third predetermined position with respect to said pivot shaft;

a motor having a drive shaft;

a drive roller provided on said drive shaft for rotation therewith, said drive roller having an outer peripheral portion;

means for supporting said motor and said drive roller for pivotal movement about said fixed pivot shaft towards said paper;

a pivot arm having two ends, one end of said pivot arm mounted on said reaction shaft to permit said pivot arm to pivot therearound towards said paper, and the other end of said pivot shaft having an aperture formed therein and said drive shaft extending through said aperture sufficiently loosely to permit said drive shaft to rotate with respect to said pivot arm;

a clutch mounted on said drive shaft and in engagement with the other end of said pivot arm;

said motor, said drive shaft, said roller, and said pivot arm normally positioned intermediate said fixed shafts in a normal position with said roller out of engagement with said top sheet of paper, and with said motor de-energized;

during energization of said motor for a first predetermined period of time to rotate said drive shaft in a predetermined direction of rotation, said clutch for (i) continuously receiving a first force from said drive shaft, and (ii) for continuously applying a second force to said other end of said pivot arm to continuously produce a first torque for causing said pivot arm to pivot around said reaction shaft and towards said paper;

upon said pivot arm pivoting towards said paper, said other end of said pivot arm continuously applying a third force to said drive shaft to continuously produce a second torque for causing said drive shaft and said motor to pivot around said shaft toward said stack of paper;

first stop means for stopping said pivoting movement of said motor and said drive shaft towards said paper at a fourth predetermined position at which said outer peripheral portion of said drive roller engages said top sheet of said paper;

upon said stopping of said pivoting movement of said drive shaft and said motor at said fourth predetermined position and upon the engagement of said outer peripheral portion of said drive roller with said top sheet of cut paper, said clutch for allowing said drive shaft to rotate in said predetermined direction of rotation to cause said drive roller to rotate in said first predetermined direction of rotation and frictionally move said top sheet of cut paper from said hopper and into said engagement with said platen;

subsequent to said drive roller moving said top sheet of paper into engagement with said platen and during energization of said motor during a second predetermined period of time to rotate said drive shaft in the direction of rotation opposite to said predetermined direction of rotation, said clutch (iii) for continuously receiving a fourth force from said drive shaft and (iv) for continuously applying a fifth force to said other end of said pivot arm to continuously produce a third torque for causing said pivot arm to pivot around said reaction shaft and away from said stack of paper and return to said normal position;

upon said pivot arm pivoting away from said stack of paper and returning to said normal position, said other end of said pivot arm continuously applying a sixth force to said drive shaft to continuously produce a fourth torque for causing said drive shaft and said motor to pivot around said pivot shaft away from said paper and return to said normal position;

subsequent to said drive roller returning to said normal position and during energization of said motor for a third predetermined period of time to cause said drive shaft to rotate in said direction of rotation opposite to said predetermined direction of rotation, said clutch (v) for continuously receiving said fourth force from said drive shaft and (vi) for continuously applying said fifth force to said other end of said pivot arm to continuously produce said third torque for causing said pivot arm to pivot around said reaction shaft and from said normal position towards said auxiliary rollers;

upon said pivot arm pivoting towards said rollers, said other end of said pivot arm continuously applying said sixth force to said drive shaft to continuously produce said fourth torque for causing said drive shaft and said motor to pivot around said pivot shaft toward said rollers;

one of said auxiliary rollers for stopping said pivoting of said motor and said drive shaft theretowards at a fifth predetermined position at which said outer peripheral portion of said drive roller engages the other of said auxiliary rollers;

upon said stopping of said pivoting movement of said drive shaft and said motor at said fifth predetermined position and upon the engagement of said outer peripheral portion of said drive roller with said other auxiliary roller, said clutch for allowing said drive shaft to rotate in said direction of rotation opposite to said predetermined direction of rotation to cause rotation of said drive roller in said direction of rotation opposite to said predetermined direction of rotation and to impart said rotation to said auxiliary rollers to cause said rollers to eject said top sheet of paper into said eject tray;

subsequent to said auxiliary rollers ejecting said top sheet of paper into said eject tray and upon the energization of said motor to rotate said drive shaft in said predetermined direction of rotation, said clutch (vii) for continuously receiving said first force from said drive shaft and (viii) for continuously applying said second force to said other end of said pivot arm to continuously produce said first torque for causing said pivot arm to pivot around said reaction shaft and return to said normal position; and upon said pivot arm pivoting into said normal position, said other end of said pivot arm continuously applying said third force to said drive shaft to continuously produce said second torque for causing said drive shaft and said motor to pivot around said pivot shaft and return to said normal position.

4. Sheet feeder apparatus for feeding the top sheet of a stack of individual sheets of cut paper from a hopper into engagement with a platen of a printer having a bail, said hopper for presenting the top sheet of cut paper at a first predetermined position, comprising:

a fixed pivot shaft for being positioned at a second predetermined position with respect to said hopper and said printer;

a fixed reaction shaft displaced from and positioned at a third predetermined position with respect to said pivot shaft;

a motor having a drive shaft;

a drive roller provided on said drive shaft for rotation therewith, said drive roller having an outer peripheral portion;

means for supporting said motor and said drive roller for pivotable movement around said fixed pivot shaft towards said paper;

a pivot arm having two ends, one end of said pivot arm mounted on said reaction shaft to permit said pivot arm to pivot therearound towards said paper, and the other end of said pivot arm having an aperture formed therein and said drive shaft extending through said aperture sufficiently loosely to permit said drive shaft to rotate with respect to said pivot arm;

a clutch mounted on said drive shaft and in engagement with the other end of said pivot arm, and said clutch during energization of said motor to rotate said drive shaft in a predetermined direction of rotation (i) for continuously receiving force from said drive shaft, and (ii) for continuously applying force to said other end of said pivot arm to continuously produce torque for causing said pivot arm to pivot around said reaction shaft and toward said paper;

upon said pivot arm pivoting towards said paper, said other end of said pivot arm continuously applying force to said drive shaft to continuously produce torque for causing said drive shaft and said motor to pivot around said pivot shaft toward said paper;

stop means for stopping said pivoting movement of said motor and said drive shaft towards said paper at a fourth predetermined position at which said outer peripheral portion of said drive roller engages said top sheet of cut paper;

upon said stopping of said pivoting movement of said drive shaft and said motor at said fourth predetermined position and upon the engagement of said outer peripheral portion of said drive roller with said top sheet of cut paper, said clutch for allowing said drive shaft to rotate with respect to said pivot arm to cause said drive roller to rotate and frictionally move said top sheet of cut paper from said hopper and into engagement with said platen;

means for moving said bail to various positions relative to said printer;

means for intermittently activating said bail moving means;

switch means interposed between said intermittent activating means and said bail moving means for selectively activating and deactivating said intermittent activating means;

means for maintaining said bail at any of said variable positions relative to said printer, said maintaining means not utilizing energy during the period of said maintaining;

means for activating said switch means for selectively intermittently moving said bail to any of said variable positions; and upon said bail being intermittently moved into a fifth predetermined position said top sheet of cut paper being advanced by said platen into a sixth predetermined position whereupon said bail, upon further intermittent activation, will be urged toward said platen and into engagement therewith, said top sheet of cut paper thereupon being interposed between said bail and said platen.

5. Sheet feeder apparatus for feeding the top sheet of a stack of individual sheets of cut paper from a hopper into engagement with a platen of a printer having a bail, said hopper for presenting the top sheet of cut paper at a first predetermined position adjacent said sheet feeder, comprising:

an eject tray for being positioned adjacent said platen and for receiving paper from said platen after printing;

at least one pair of opposed auxiliary rollers for being positioned intermediate said platen and said eject tray and upon rotation thereof and upon a sheet of paper being interposed therebetween by said platen said rollers for ejecting paper into said eject tray;

said sheet feeder also for imparting rotation to said auxiliary rollers;

said sheet feeder further comprising:

a fixed pivot shaft for being positioned at a second predetermined position with respect to said hopper and said printer;

a fixed reaction shaft displaced from and positioned at a third predetermined position with respect to said pivot shaft;

a motor having a drive shaft;

a drive roller provided on said drive shaft for rotation therewith, said drive roller having an outer peripheral portion;

means for supporting said motor and said drive roller for pivotal movement about said fixed pivot shaft towards said paper;

a pivot arm having two ends, one end of said pivot arm mounted on said reaction shaft to permit said pivot arm to pivot therearound towards said paper, and the other end of said pivot shaft having an aperture formed therein and said drive shaft extending through said aperture sufficiently loosely to permit said drive shaft to rotate with respect to said pivot arm;

a clutch mounted on said drive shaft and in engagement with the other end of said pivot arm;

said motor, said drive shaft, said roller, and said pivot arm normally positioned intermediate said fixed shafts in a normal position with said roller out of engagement with said top sheet of paper, and with said motor de-energized;

during energization of said motor for a first predetermined period of time to rotate said drive shaft in a predetermined direction of rotation, said clutch for (i) continuously receiving a first force from said drive shaft, and (ii) for continuously applying a second force to said other end of said pivot arm to continuously produce a first torque for causing said pivot arm to pivot around said reaction shaft and towards said paper;

upon said pivot arm pivoting towards said paper, said other end of said pivot arm continuously applying a third force to said drive shaft to continuously produce a second torque for causing said drive shaft and said motor to pivot around said shaft towards said stack of paper;

first stop means for stopping said pivoting movement of said motor and said drive shaft towards said paper at a fourth predetermined position at which said outer peripheral portion of said drive roller engages said top sheet of said paper;

upon said stopping of said pivoting movement of said drive shaft and said motor at said fourth predetermined position and upon the engagement of said outer peripheral portion of said drive roller with said top sheet of cut paper, said clutch for allowing said drive shaft to rotate in said predetermined direction of rotation to cause said drive roller to rotate in said first predetermined direction of rotation and frictionally move said top sheet of cut paper from said hopper and into said engagement with said platen;

subsequent to said drive roller moving said top sheet of paper into engagement with said platen and during energization of said motor during a second predetermined period of time to rotate said drive shaft in the direction of rotation opposite to said predetermined direction of rotation, said clutch (iii) for continuously receiving a fourth force from said drive shaft and (iv) for continuously applying a fifth force to said other end of said pivot arm to continuously produce a third torque for causing said pivot arm to pivot around said reaction shaft and away from said stack of paper and return to said normal position;

upon said pivot arm pivoting away from said stack of paper and returning to said normal position, said other end of said pivot arm continuously applying a sixth force to said drive shaft to continuously produce a fourth torque for causing said drive shaft and said motor to pivot around said pivot shaft away from said paper and return to said normal position;

means for moving said bail to various positions relative to said printer;

means for intermittently activating said bail moving means;

switch means interposed between said intermittent activating means and said bail moving means for selectively activating and deactivating said intermittent activating means;

means for maintaining said bail at any of said variable positions relative to said printer, said maintaining means not utilizing energy during the period of said maintaining;

means for activating said switch means for selectively intermittently moving said bail to any of said variable positions;

upon said bail being intermittently moved into a fifth predetermined position said top sheet of cut paper being advanced by said platen into a sixth predetermined position whereupon said bail, upon further intermittent activation, will be urged toward said platen and into engagement therewith, said top sheet of cut paper thereupon being interposed between said bail and said platen;

subsequent to said drive roller returning to said normal position and during energization of said motor for a third predetermined period of time to cause said drive shaft to rotate in said direction of rotation opposite to said predetermined direction of rotation, said clutch (v) for continuously receiving said fourth force from said drive shaft and (vi) for continuously applying said fifth force to said other end of said pivot arm to continuously produce said third torque for causing said pivot arm to pivot around said reaction shaft and from said normal position towards said auxiliary rollers;

upon said pivot arm pivoting towards said rollers, said other end of said pivot arm continuously applying said sixth force to said drive shaft to continuously produce said fourth torque for causing said drive shaft and said motor to pivot around said pivot shaft toward said rollers;

one of said auxiliary rollers for stopping said pivoting of said motor and said drive shaft theretowards at a seventh predetermined position at which said outer peripheral portion of said drive roller engages the other of said auxiliary rollers;

upon said stopping of said pivoting movement of said drive shaft and said motor at said seventh predetermined position and upon the engagement of said outer peripheral portion of said drive roller with said other auxiliary roller, said clutch for allowing said drive shaft to rotate in said direction of rotation opposite to said predetermined direction of rotation to cause rotation of said drive roller in said direction of rotation opposite to said predetermined direction of rotation and to impart said rotation to said auxiliary rollers to cause said rollers to, upon the interposition therebetween of said top sheet of paper, eject said top sheet of paper into said eject tray;

subsequent to said auxiliary rollers ejecting said top sheet of paper into said eject tray and upon the energization of said motor to rotate said drive shaft in said predetermined direction of rotation, said clutch (vii) for continuously receiving said first force from said drive shaft and (viii) for continuously applying said second force to said other end of said pivot arm to continuously produce said first torque for causing said pivot arm to pivot around said reaction shaft and return to said normal position; and upon said pivot arm pivoting into said normal position, said other end of said pivot arm continuously applying said third force to said drive shaft to continuously produce said second torque for causing said drive shaft and said motor to pivot around said pivot shaft and return to said normal position.

6. A bail actuating apparatus according to claim 4 or 5 wherein said intermittent activating means comprises a pulse activated solenoid.

7. A bail actuating mechanism according to claim 6 wherein said maintaining means comprises a pawl and ratchet.

8. Sheet feeder apparatus for feeding the top sheet of a stack of individual sheets of cut paper from a spring loaded hopper having triangular paper stops into engagement with a platen of a printer having a bail, said hopper for presenting the top sheet of cut paper at a first predetermined position, said triangular paper stops for permitting movement of individual sheets, comprising:

a fixed pivot shaft for being positioned at a second predetermined position with respect to said hopper and said printer;

a fixed reaction shaft displaced from and positioned at a third predetermined position with respect to said pivot shaft;

a motor having a drive shaft;

a drive roller provided on said drive shaft for rotation therewith, said drive roller having an outer peripheral portion;

means for supporting said motor and said drive roller for pivotable movement around said fixed pivot shaft towards said paper;

a pivot arm having two ends, one end of said pivot arm mounted on said reaction shaft to permit said pivot arm to pivot therearound towards said paper, and the other end of said pivot arm having an aperture formed therein and said drive shaft extending through said aperture sufficiently loosely to permit said drive shaft to rotate with respect to said pivot arm;

a clutch mounted on said drive shaft and in engagement with the other end of said pivot arm; and said clutch during energization of said motor to rotate said drive shaft in a predetermined direction of rotation (i) for continuously receiving force from said drive shaft, and (ii) for continuously applying force to said other end of said pivot arm to continuously produce torque for causing said pivot arm to pivot around said reaction shaft and toward said paper;

upon said pivot arm pivoting towards said paper, said other end of said pivot arm continuously applying force to said drive shaft to continuously produce torque for causing said drive shaft and said motor to pivot around said pivot shaft toward said paper;

stop means for stopping said pivoting movement of said motor and said drive shaft towards said paper at a fourth predetermined position at which said outer peripheral portion of said drive roller engages said top sheet of cut paper;

upon said stopping of said pivoting movement of said drive shaft and said motor at said fourth predetermined position and upon the engagement of said outer peripheral portion of said drive roller with said top sheet of cut paper, said clutch for allowing said drive shaft to rotate with respect to said pivot arm to cause said drive roller to rotate and frictionally move said top sheet of cut paper from said hopper and into engagement with said platen;

triangular paper stop means for permitting the movement of only individual sheets of cut paper from said hopper, said triangular paper stop means being adjustable for enabling said hopper to selectively accommodate various widths of paper therein;

means for moving said bail to various positions relative to said printer;

means for intermittently activating said bail moving means;

switch means interposed between said intermittent activating means and said bail moving means for selectively activating and deactivating said intermittent activating means;

means for maintaining said bail at any of said variable positions relative to said printer, said maintaining means not utilizing energy during the period of said maintaining;

means for activating said switch means for selectively intermittently moving said bail to any of said variable positions; and upon said bail being intermittently moved into a fifth predetermined position said top sheet of cut paper being advanced by said platen into a sixth predetermined position whereupon said bail, upon further intermittent activation, will be urged toward said platen and into engagement therewith, said top sheet of cut paper thereupon being interposed between said bail and said platen.

9. Sheet feeder apparatus for feeding the top sheet of a stack of individual sheets of cut paper from a spring loaded hopper having triangular paper stops into engagement with a platen of a printer having a bail, said hopper for presenting the top sheet of cut paper at a first predetermined position adjacent said sheet feeder, said triangular paper stops for permitting movement of individual sheets, comprising:

an eject tray for being positioned adjacent said platen and for receiving paper from said platen after printing;

at least one pair of opposed auxiliary rollers for being positioned intermediate said platen and said eject tray and upon rotation thereof and upon a sheet of paper being interposed therebetween by said platen said rollers for ejecting paper into said eject tray;

said sheet feeder also for imparting rotation to said auxiliary rollers;

said sheet feeder further comprising:

a fixed pivot shaft for being positioned at a second predetermined position with respect to said hopper and said printer;

a fixed reaction shaft displaced from and positioned at a third predetermined position with respect to said pivot shaft;

a motor having a drive shaft;

a drive roller provided on said drive shaft for rotation therewith, said drive roller having an outer peripheral portion;

means for supporting said motor and said drive roller for pivotal movement about said fixed pivot shaft towards said paper;

a pivot arm having two ends, one end of said pivot arm mounted on said reaction shaft to permit said pivot arm to pivot therearound towards said paper, and the other end of said pivot shaft having an aperture formed therein and said drive shaft extending through said aperture sufficiently loosely to permit said drive shaft to rotate with respect to said pivot arm;

a clutch mounted on said drive shaft and in engagement with the other end of said pivot arm;

said motor, said drive shaft, said roller, and said pivot arm normally positioned intermediate said fixed shafts in a normal position with said roller out of engagement with said top sheet of paper, and with said motor de-energized;

during energization of said motor for a first predetermined period of time to rotate said drive shaft in a predetermined direction of rotation, said clutch for (i) continuously receiving a first force from said drive shaft, and (ii) for continuously applying a second force to said other end of said pivot arm to continuously produce a first torque for causing said pivot arm to pivot around said reaction shaft and towards said paper;

upon said pivot arm pivoting towards said paper, said other end of said pivot arm continuously applying a third force to said drive shaft to continuously produce a second torque for causing said drive shaft and said motor to pivot around said shaft towards said stack of paper;

first stop means for stopping said pivoting movement of said motor and said drive shaft towards said paper at a fourth predetermined position at which said outer peripheral portion of said drive roller engages said top sheet of said paper;

upon said stopping of said pivoting movement of said drive shaft and said motor at said fourth predetermined position and upon the engagement of said outer peripheral portion of said drive roller with said top sheet of cut paper, said clutch for allowing said drive shaft to rotate in said predetermined direction of rotation to cause said drive roller to rotate in said first predetermined direction of rotation and frictionally move said top sheet of cut paper from said hopper and into said engagement with said platen;

triangular paper stop means for permitting the movement of only individual sheets of cut paper from said hopper, said triangular paper stop means being adjustable for enabling said hopper to selectively accommodate various widths of paper therein;

subsequent to said drive roller moving said top sheet of paper into engagement with said platen and during energization of said motor during a second predetermined period of time to rotate said drive shaft in the direction of rotation opposite to said predetermined direction of rotation, said clutch (iii) for continuously receiving a fourth force from said drive shaft and (iv) for continuously applying a fifth force to said other end of said pivot arm to continuously produce a third torque for causing said pivot arm to pivot around said reaction shaft and away from said stack of paper and return to said normal position;

upon said pivot arm pivoting away from said stack of paper and returning to said normal position, said other end of said pivot arm continuously applying a sixth force to said drive shaft to continuously produce a fourth torque for causing said drive shaft and said motor to pivot around said pivot shaft away from said paper and return to said normal position;

means for moving said bail to various positions relative to said printer;

means for intermittently activating said bail moving means;

switch means interposed between said intermittent activating means and said bail moving means for selectively activating and deactivating said intermittent activating means;

means for maintaining said bail at any of said variable positions relative to said printer, said maintaining means not utilizing energy during the period of said maintaining;

means for activating said switch means for selectively intermittently moving said bail to any of said variable positions;

upon said bail being intermittently moved into a fifth predetermined position said top sheet of cut paper being advanced by said platen into a sixth predetermined position whereupon said bail, upon further intermittent activation, will be urged toward said platen and into engagement therewith, said top sheet of cut paper thereupon being interposed between said bail and said platen;

subsequent to said drive roller returning to said normal position and during energization of said motor for a third predetermined period of time to cause said drive shaft to rotate in said direction of rotation opposite to said predetermined direction of rotation, said clutch (v) for continuously receiving said fourth force from said drive shaft and (vi) for continuously applying said fifth force to said other end of said pivot arm to continuously produce said third torque for causing said pivot arm to pivot around said reaction shaft and from said normal position towards said auxiliary rollers;

upon said pivot arm pivoting towards said rollers, said other end of said pivot arm continuously applying said sixth force to said drive shaft to continuously produce said fourth torque for causing said drive shaft and said motor to pivot around said pivot shaft toward said rollers;

one of said auxiliary rollers for stopping said pivoting of said motor and said drive shaft theretowards at a seventh predetermined position at which said outer peripheral portion of said drive roller engages the other of said auxiliary rollers;

upon said stopping of said pivoting movement of said drive shaft and said motor at said seventh predetermined position and upon the engagement of said outer peripheral portion of said drive roller with said other auxiliary roller, said clutch for allowing said drive shaft to rotate in said direction of rotation opposite to said predetermined direction of rotation to cause rotation of said drive roller in said direction of rotation opposite to said predetermined direction of rotation and to impart said rotation to said auxiliary rollers to cause said rollers to, upon the interposition therebetween of said top sheet of paper, eject said top sheet of paper into said eject tray;

subsequent to said auxiliary rollers ejecting said top sheet of paper into said eject tray and upon the energization of said motor to rotate said drive shaft in said predetermined direction of rotation, said clutch (vii) for continuously receiving said first force from said drive shaft and (viii) for continuously applying said second force to said other end of said pivot arm to continuously produce said first torque for causing said pivot arm to pivot around said reaction shaft and return to said normal position; and upon said pivot arm pivoting into said normal position, said other end of said pivot arm continuously applying said third force to said drive shaft to continuously produce said second torque for causing said drive shaft and said motor to pivot around said pivot shaft and return to said normal position.

* * * * *